United States Patent [19]

Cerna

[11] 4,340,132

[45] Jul. 20, 1982

[54] SUITCASE AND CART ASSEMBLY

[75] Inventor: Juan F. Cerna, Miami, Fla.

[73] Assignee: J.F.C. Investments, Inc., Miami, Fla.

[21] Appl. No.: 224,490

[22] Filed: Jan. 12, 1981

[51] Int. Cl.[3] ..... A45C 13/38; B62B 1/12

[52] U.S. Cl. ..... 190/18 A; 190/58 B; 280/47.13 R

[58] Field of Search ..... 190/18 A, 60, 58 B; 280/47.13 R, 37, 43.1, 43.12

[56] References Cited

U.S. PATENT DOCUMENTS

| | | | |
|---|---|---|---|
| 2,733,076 | 1/1956 | Burnett | 280/36 |
| 4,036,336 | 7/1977 | Burtley | 190/18 A |
| 4,114,916 | 9/1978 | Oyama | 280/47.29 |

FOREIGN PATENT DOCUMENTS

| | | | |
|---|---|---|---|
| 2353629 | 5/1974 | Fed. Rep. of Germany | 190/18 A |

*Primary Examiner*—William Price
*Assistant Examiner*—Gary E. Elkins
*Attorney, Agent, or Firm*—Oltman and Flynn

[57] ABSTRACT

A pair of wheeled L-shaped frame members are snugly received in channels in the bottom of the suitcase and are telescopically engaged by a generally U-shaped handle at their upper ends and a generally U-shaped base at their lower ends. Plates on the bottom of the suitcase hold the frame members in the channels, and these plates are slidably retractable to uncover the channels for removal of the frame members without disconnecting them from the handle on the base.

3 Claims, 6 Drawing Figures

FIG. 4
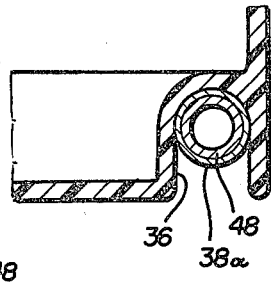
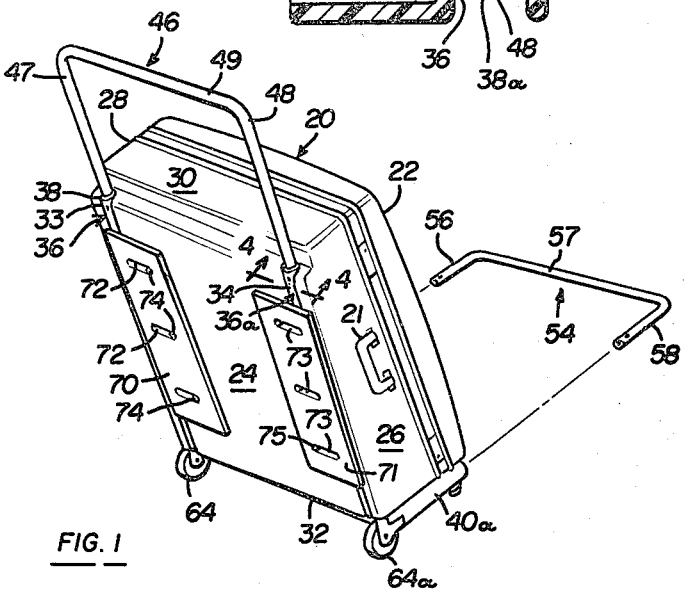
FIG. 1
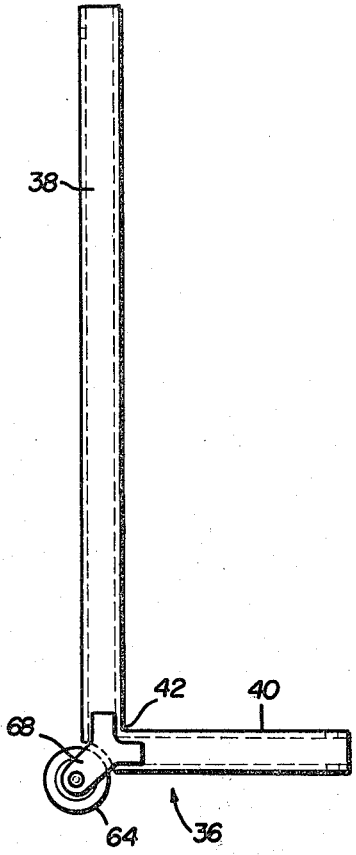
FIG. 5
FIG. 2
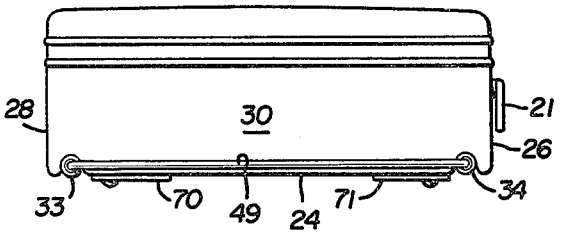
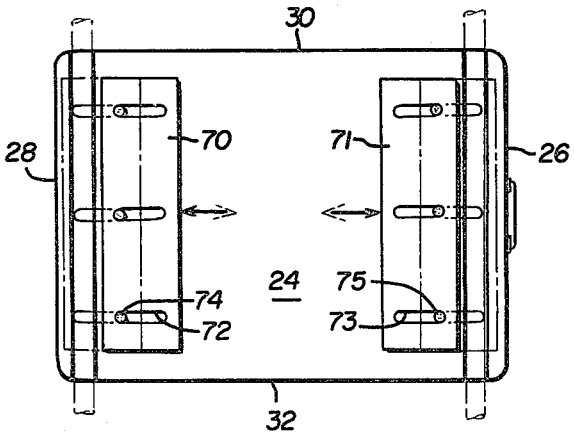
FIG. 3
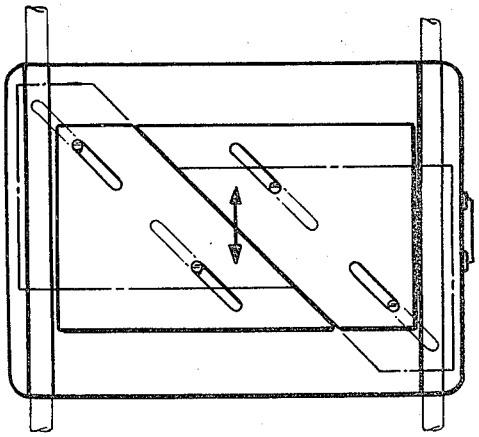
FIG. 6

SUITCASE AND CART ASSEMBLY

CROSS-REFERENCE TO RELATED APPLICATION

The present application is an improvement of copending U.S. patent application, Ser. No. 06/115,797, filed Jan. 28, 1980. now U.S. Pat. No. 4,261,447.

BACKGROUND OF THE INVENTION

U.S. Pat. No. 4,036,336 to Burtley discloses a wheeled suitcase convertible to a luggage cart in which a handle is combined with pivotal support arms attached to the bottom of the suitcase providing an additional luggage supporting surface.

SUMMARY OF THE INVENTION

The present invention is directed to a suitcase and cart assembly having a wheeled cart which is readily attachable and removable as a unit to and from a suitcase.

In accordance with the present invention, the cart comprises a pair of wheeled L-shaped frame members held parallel to one another by a generally U-shaped handle at the top and a generally U-shaped base at the bottom. Both the handle and the base preferably are telescopically extensible and retractable with respect to the frame members. The bottom wall of the suitcase has channels which snugly but slidably receive the respective frame members. Closure plates are slidably mounted on the bottom wall of the suitcase for adjustment between extended positions, in which they cover the channels and hold the frame members in the channels, and retracted positions, in which they uncover the channels and permit the insertion or removal of the frame members. The frame members, handle and base are attachable and detachable as a unit to and from the suitcase.

A principal object of this invention is to provide a novel assembly of a wheeled cart and a suitcase in which the cart may be attached and removed as a unit to and from the suitcase without requiring any assembly or disassembly of the components of the cart itself.

Further objects and advantages of this invention will be apparent from the following detailed description of two presently-preferred embodiments thereof, shown in the accompany drawing.

DESCRIPTION OF THE DRAWINGS

FIG. 1 is a perspective view of a first embodiment of the present invention with its extensible base separated and shown in exploded perspective;

FIG. 2 is a top plan view of the apparatus shown in FIG. 1;

FIG. 3 is a rear elevation of the suitcase in FIG. 1;

FIG. 4 is an enlarged fragmentary cross section taken along the 4—4 in FIG. 1;

FIG. 5 is a side elevation showing one of the wheeled frame members in the present invention; and FIG. 6 is a rear elevation of a modified suitcase in the present invention with certain parts removed.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The suitcase 20 includes a top wall 22, a bottom wall 24 (FIG. 4) extending in spaced parallel relationship to the top wall when the suitcase is closed, a front wall 26 to which a carrying handle 21 is pivoted, a rear wall 28 extending in spaced parallel relationship to the front wall, a left side wall 30 extending perpendicularly between the top and bottom walls 22 and 24 and perpendicularly between the front and rear walls 26 and 28, and a right side wall 32 extending in spaced parallel relationship to the left side wall 30 between the top and bottom walls and between the front and rear walls.

In accordance with the present invention, the bottom wall 24 of the suitcase is formed with a pair of rounded channels 33 and 34 which respectively extend close to its rear and front walls 28 and 26 and parallel to the latter. Each of these channels is open at the bottom of the suitcase for its entire length between its left and right side walls 30 and 32.

A wheeled L-shaped frame member 36, as shown in FIG. 5, has its longer leg 38 snugly received in the left channel 33 and its shorter leg 40 extending beneath the right side wall 32 of the suitcase. The legs of the frame member 36 are of tubular construction and are joined to each other at a corner 42. At this corner a bracket 68 rotatably supports a roller 64 which is located at the outside of the corner.

An identical wheeled, L-shaped frame member **36*a* has its longer leg 38*a* (FIG. 1) seated in the right channel 34 and its shorter leg 40a extending beneath the right side wall 32 of the suitcase. This frame member carriers a roller 64*a* at the outside of the corner between its legs 38*a* and 40*a***.

A generally U-shaped handle 46 has parallel legs 47 and 48 which are slidably received in the open upper ends of the longer legs 38 and **38*a*, respectively, of the wheeled L-shaped frame members 36 and 36*a*. The parallel legs of the handle are interconnected by a cross arm 49. The handle 46 may be extended out from the left side wall 30 of the suitcase, as shown in FIG. 1, for convenient gripping of its cross arm 49 by a user while pulling the wheeled suitcase cart along a floor or other surface in which he or she is walking. Alternatively, the handle 46 may be retracted into the wheeled frame members 36 and 36*a* to position its cross arm 49 next to the corner of the suitcase between the left side wall 30 and the bottom wall 24. A spring-operated detent or any other suitable releasable locking arrangement (not shown) may be provided between the handle legs 47, 48 and the longer arms 38 and 38*a*** of the respective L-shaped frame members to hold the handle in either its extended position or its retracted position.

A generally U-shaped base 54 has parallel legs 56 and 58 slidably received in the shorter legs 40 and **40*a* of the L-shaped frame members thereby maintaining these legs of the frame members parallel to each other. The base has a cross arm 57 extending between its parallel legs 56 and 58. The base is adjustable between a retracted position, in which its cross arm 57 extends close to the adjacent end of the frame arms 40 and 40*a*, and an extended position, in which its cross arm 57 is positioned a substantial distance outward from the frame arms 40 and 40*a*, so that the legs 56 and 58 are extensions of the frame arms 40 and 40*a***. This enables an additional piece of luggage to be supported on the base 56–58 in front of the suitcase 20. Any suitable spring detent or other releasable locking arrangement (not shown) may be provided for holding the base 54 in either its retracted position or its extended position.

The entire assembly of the wheeled L-shaped frame members 36 and 36*a*, the handle 46 and the lower base 54 may be removed as a unit from the suitcase 20, when desired, such as when the suitcase will be carried at its top handle 21. The longer legs 38 and 38*a* of the respective members 36 and 36*a* are snugly but slidably received in the respective channels 33 and 34 in the bottom 24 of the suitcase.

In accordance with the present invention, a pair of closures in the form of flat plates 70 and 71 normally extend across the open side of the respective channels 33 and 34 and retain the legs 38 and 38*a* of the frame members snugly in place in these channels. The closure plates are each formed with several transverse slots 72 and 73 which slidably engage respective projections 74 and 75, such as headed pins, attached to the bottom wall of the suitcase. These slots and projections act as guides for the plates to guide their movement between their respective extended positions (FIG. 1), in which the plates extend across the channels 33 and 34 and the laterally inward ends of the slots 72 and 73 engage the respective projections 74 and 75, and their respective retracted positions (FIG. 3), in which the plates uncover the channels and the laterally outward ends of the slots 72 and 73 engage the respective projections 74 and 75. When both plates are retracted, the longer arms 38 and 38*a* of the wheeled L-shaped frame members can be removed from the channels 33 and 34 simply by pulling on the handle 46 and without having to disassemble the handle from these frame members before such removal. Thus, the entire wheeled cart may be removed as a unit from the suitcase or attached to it as a unit without requiring any diassembly or assembly of the cart.

FIG. 6 shows a modified arrangement in which the closure plates 70*a* and 71*a* have respective slots 72*a* and 73*a* which are elongated at an acute angle to the respective channels 33*a* and 34*a* in the bottom wall of the suitcase. Consequently, the plates are adjustable between the retracted positions uncovering the channels, as shown in full lines in FIG. 6, and the extended positions covering the channels, as shown in phantom in FIG. 6.

I claim:

1. In combination:

a suitcase having a top wall, a bottom wall and two pairs of opposite side walls, said bottom wall presenting a pair of open channels which extend in close proximity to and parallel to one pair of opposite side walls;

a pair of substantially L-shaped tubular frame members, each having two legs adjoining each other at a corner, each of said frame members having one of its legs snugly seated in a corresponding channel in said bottom wall and slidably removable therefrom; the other leg of each of said frame members extending parallel to said one pair of opposite side walls adjacent a third of said side walls;

a generally U-shaped handle having parallel legs telescopically received respectively in said one legs of said frame members for manipulating said suitcase; said handle having a cross arm movable from a retracted position near the fourth of said side walls to an extended operating position spaced outward from said fourth side wall;

and a pair of closures adjustably mounted on said bottom wall for adjustment between respective first positions extending across said channels to retain said one legs of the frame members therein and respective second positions uncovering said channels to permit removal of said one legs of said frame members therefrom;

said closures comprising flat plates slidably mounted on the outside of said bottom wall between said channels, and further comprising means acting between said bottom wall and said plates for guiding said plates laterally of said channels when the plates are adjusted between said first and second positions thereof.

2. The combination of claim 1, and further comprising:

a generally U-shaped base having parallel legs telescopically received in said other legs of said frame members for retaining an additional article;

said base having a cross arm movable from a retracted position near the top wall to an extended position spaced away from said top wall for holding an additional article on the base;

and wheeled means affixed to the corners of said L-shaped frame members for permitting said suitcase to be wheeled along by manipulation of said handle with or without an additional article on said base.

3. The combination of claim 2, wherein said closures are flat plates slidably mounted on the outside of said bottom wall between said channels, and further comprising means acting between said bottom wall and said plates for guiding said plates laterally of said channels when the plates are adjusted between said first and second positions thereof.

* * * * *